United States Patent [19]

Turner et al.

[11] 4,364,188

[45] Dec. 21, 1982

[54] RUNNING SHOE WITH REAR STABILIZATION MEANS

[75] Inventors: Jerome A. Turner, Baltimore, Md.; George W. Dietel, Hanover, Pa.

[73] Assignee: Wolverine World Wide, Inc., Rockford, Mich.

[21] Appl. No.: 194,485

[22] Filed: Oct. 6, 1980

[51] Int. Cl.[3] ..... A43B 13/14; A43B 13/12; A43B 13/04; A43B 5/06

[52] U.S. Cl. ..... 36/31; 36/30 R; 36/32 R; 36/91; 36/129

[58] Field of Search ..... 36/31, 30 R, 32 R, 28, 36/71.5, 73, 91, 104, 81, 82, 43, 59 B, 129

[56] References Cited

U.S. PATENT DOCUMENTS

| | | | |
|---|---|---|---|
| 2,885,797 | 5/1959 | Chrencik | 36/91 |
| 3,293,494 | 12/1966 | Fischer | 36/32 R |
| 4,128,950 | 12/1978 | Bowerman et al. | 36/30 R |
| 4,237,626 | 12/1980 | Brown | 36/43 |
| 4,246,706 | 1/1981 | Persons, Jr. | 36/73 |
| 4,302,892 | 12/1981 | Adamik | 36/31 |

FOREIGN PATENT DOCUMENTS

| | | | |
|---|---|---|---|
| 2751146 | 5/1979 | Fed. Rep. of Germany | 36/31 |
| 279265 | 3/1952 | Switzerland | 36/28 |

*Primary Examiner*—James Kee Chi

*Attorney, Agent, or Firm*—Price, Heneveld, Huizenga and Cooper

[57] ABSTRACT

A running shoe having an outer sole and a midsole. The midsole comprises a forefoot portion, an arch portion and a heel portion all formed of a resilient material having a first durometer sufficiently low to provide good cushioning and impact absorption. Rear foot stabilization means in the form of a mass of resilient material is located and confined within the midsole adjacent the medial side of the heel portion. The durometer of the stabilization means is higher than the durometer of the midsole to provide resistance to compression at the medial side of the heel portion, thereby lessening the tendency of the shoe to overpronation. In one embodiment, the stabilization means comprises plural plugs confined fully within the midsole. In another embodiment, the stabilization means extend through the outsole and into the insole.

20 Claims, 15 Drawing Figures

FIG. 9
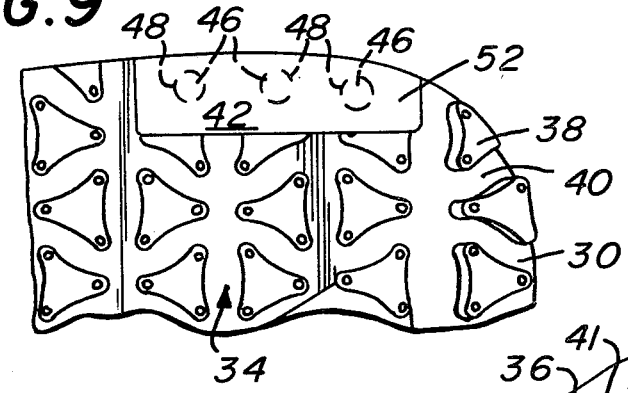
FIG. 8
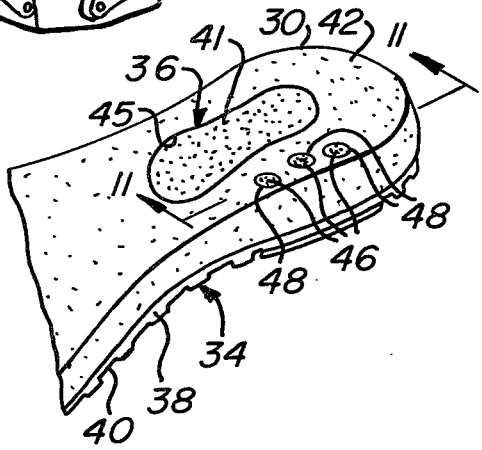
FIG. 10
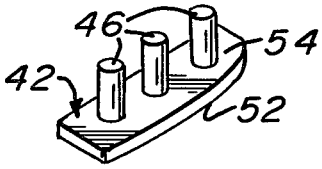
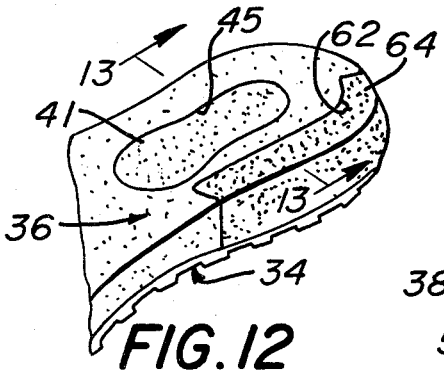
FIG. 12
FIG. 11
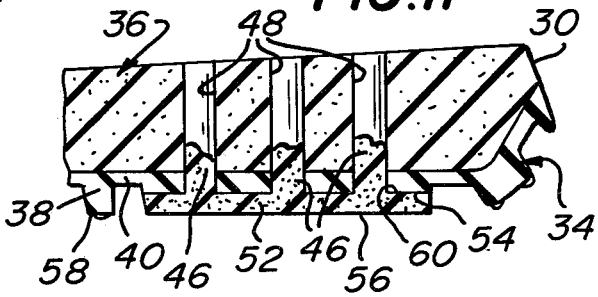
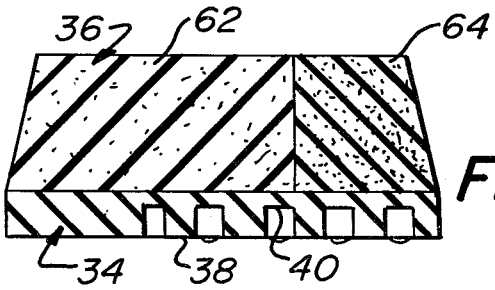
FIG. 13

RUNNING SHOE WITH REAR STABILIZATION MEANS

This invention relates generally to athletic shoes and, more particularly, to running shoes and sole components therefore.

The sole structure of most running shoes commercially available today is of a tripartite construction including an outersole, a midsole and an innersole. The outer sole is normally formed of a tough, abrasion resistant material since it is the portion of the sole which contacts the ground. The midsole is the portion of the shoe between the outersole and the innersole and its function is to provide lift for the heel and cushioning and impact or shock absorption for the entire shoe.

As is recognized by those skilled in the running shoe art, as well as those millions of recreational runners, good impact absorption is an extremely important characteristic desired in running shoes. This is particularly true where the shoes are used for long distance running. Accordingly, ideally, the running shoe sole should be soft enough to provide adequate cushioning and comfort yet being sufficiently tough to withstand shock. Since the outer sole must be sufficiently tough to withstand abrasion, the attention of shoe designers has been directed to the midsole for effecting shock absorption and cushioning.

While very soft materials for the midsole, e.g., materials of approximately 20 durometer or less, may exhibit good flexibility and cushioning, such materials are not suitable for use in a running shoe since they soon collapse and become virtually useless for absorbing shock. Accordingly, harder, yet still relatively soft materials, e.g., 35 durometer, are commonly utilized in the midsoles of most quality running shoes commercially available today since such materials have been found to exhibit a good combination of flexibility, shock absorption, cushioning and longevity.

It has been found that a substantial number of runners have a tendency to overpronate during the running cycle, particularly when wearing shoes whose midsoles are relatively soft, e.g., 35 durometer. As is known, overpronation constitutes the excessive inward roll of the foot following the heel strike and prior to the toe off portion of the running motion and In U.S. Pat. No. 4,180,924, assigned to the same assignee as this invention, there is disclosed and claimed running shoes constructed to lessen abnormal pronation of the foot as the arch flattens during running. To that end, those shoes comprise a sole formed of a resilient material and having a wedge portion extending from the heel to a point beyond the arch of the wearer's foot and immediately to the rear of the first metatarsal head of the foot. The wedge portion is canted upward in the transverse direction from the outside edge of the shoe to the inside edge of the shoe so that during running a substantial portion of the sole makes contact with the ground during each step. The sole is constructed to be thicker at portions adjacent to the heel than at portions adjacent to the toe and is formed of an outsole, a midsole and an intermediate bevelled section disposed therebetween at the heel. The transverse wedge portion of the sole is formed by the midsole. The midsole and bevelled section may be formed as an integral unit.

In U.S. Pat. No. 2,885,797, a non-sport shoe is disclosed having a wedge portion and formed of an excessively soft cushioning material. In order to provide stability, a plurality of spaced plug elements formed of less yieldable material are provided in the heel area surrounding the central heel bone. The plugs are not confined to the medial side of the heel to preclude a tendency to overpronation.

Tred 2 Sport Shoes of San Jose, Calif. has offered a running shoe having a sole construction identified by the trademark DOUBLE D. The DOUBLE D sole is formed of a higher durometer material in the heel area and a portion of the arch area than in the remaining portion of the sole to preclude over-pronation. However, the higher durometer material is not confined to the medial side of the heel.

It is a general object of the instant invention to provide a running shoe having a sole component which serves to lessen abnormal or overpronation of foot during running, yet which provides good cushioning and impact absorption in the heel area.

It is a further object of the instant invention to provide in an athletic shoe means for providing rear foot stabilization while providing good cushioning and impact absorption in the heel area.

It is a further object of the instant invention to provide in a running shoe means for providing rear foot stabilization, the degree of which being established in accordance with the needs of the runner.

These and other objects of the instant invention are achieved by providing in a running shoe a sole component comprising a forefoot portion, an arch portion and a heel portion, all formed of a first resilient material. Rear foot stabilization means are provided. The rear foot stabilization means comprise a mass of a second resilient material located and confined in the heel portion adjacent the medial side thereof. The first resilient material has a first durometer sufficiently low to provide good cushioning and shock absorption. The second resilient material has a second durometer, higher than the first durometer, to provide increased resistance to compression at the medial side of the heel portion, thereby lessening a tendency toward overpronation.

Other objects and many of the attendant advantages of the instant invention will be readily appreciated as the same becomes better understood by reference to the following detailed description when considered in connection with the accompanying drawing wherein:

FIG. 8 is a perspective view, similar to FIG. 5 showing a portion of yet another alternative embodiment of the sole of the instant invention;

FIG. 9 is a plan view, similar to that of FIG. 6 and showing the heel portion of the outside sole shown in FIG. 8;

FIG. 10 is a perspective view of one embodiment of heel stabilization means for use in the sole of FIG. 9;

FIG. 11 is an enlarged sectional view taken along line 11—11 of FIG. 8;

FIG. 12 is a perspective view of still another alternative embodiment of the sole of the instant invention;

FIG. 13 is an enlarged sectional view taken along line 13—13 of FIG. 12;

Referring now to the various figures of the drawing wherein like reference characters refer to like parts, there is shown at 20 one running shoe of a pair of running shoes constructed in accordance with the instant invention.

Figure 1:
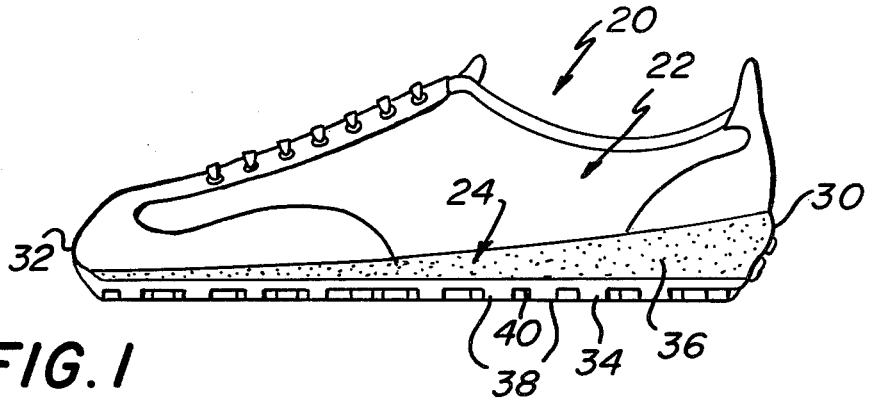
FIG. 1 is a side elevational view of one running shoe of a pair of running shoes constructed in accordance with the instant invention.

Each shoe basically comprises an upper portion 22, an innersole (not shown) and a sole unit or assembly 24. The sole assembly 24 has an inner or medial side 26 (FIG. 3) and an outerside 28 (FIG. 3) and extends the entire length of the shoe from the heel 30 to the toe 32. The upper portion 22 of the shoe is of conventional construction and for that reason will not be described in detail herein.

The sole assembly 24 of each shoe is constructed in accordance with the instant invention to provide improved rear foot stability while still providing good cushioning and impact or shock absorption.

Figure 2:
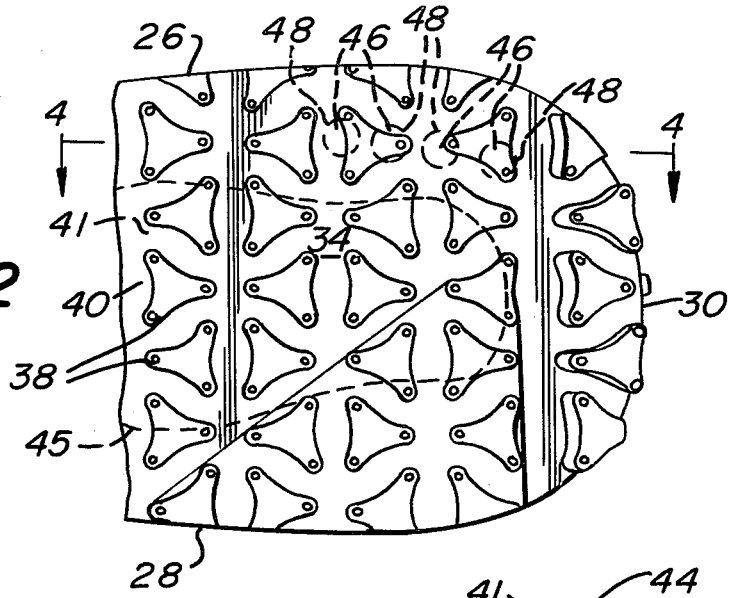
FIG. 2 is an enlarged plan view of the heel portion of the outsole of the shoe shown in FIG. 1.
Figure 3:
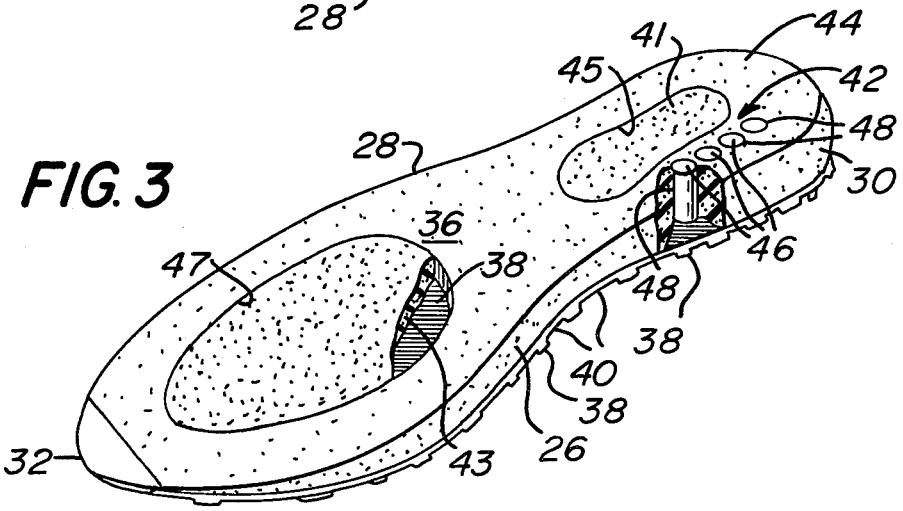
FIG. 3 is an enlarged perspective view of the sole portion of the shoe shown in FIG. 1.
Figure 4:
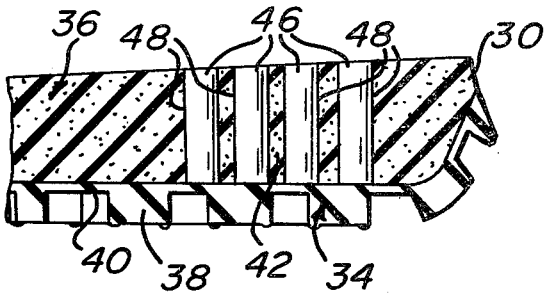
FIG. 4 is an enlarged sectional view taken along line 4—4 of FIG. 2.

As can be seen in FIGS. 1 and 3, the sole assembly 24 basically comprises an outersole 34 and a midsole 36, each formed of a resilient and flexible material, e.g., ethylene-vinyl, acetate, copolymer, etc. The outersole runs the entire length and width of the shoe and is arranged to contact the ground. In accordance with conventional construction practice, the outersole is of substantially uniform thickness throughout and includes plural gripping elements or cleats 38 (FIG. 2) projecting downward from its underside surface 40.

The midsole 36 is constructed in accordance with the teaching of the instant invention and runs from the heel of the shoe to the toe. The midsole extends the full width of the sole between the inner and outer sides of the shoe and is bevelled downward from heel to toe to provide heel lift for the shoe. In accordance with the preferred embodiment of the invention, the midsole is formed of a material which is sufficiently hard to provide adequate shock absorption, yet still being relatively soft to provide adequate cushioning and comfort. A 35 durometer foamed closed cell resilient ethylene-vinyl, acetate copolymer forms a particularly effective midsole since it provides a good combination of flexibiliity, shock absorption, cushioning and longevity. The aforesaid 35 durometer hardness value as well as the other durometer values discussed hereinafter in connection with the insert and stabilization means are determined in accordance with ASTM standards test D2240 and by other known ASTM standards. In the case of midsole 36, the hardness is Shore A 35 hardness with a density of twelve pounds per cubic foot.

In order to further effectuate cushioning, a pair of resilient inserts 41 and 43 are located within respective mating recesses 45 and 47 in the midsole. One recess 45 is located in the heel area 44 and the other recess 47 is located in the forefoot area. The inserts are formed of a resilient material, such as foamed closed cell ethylene-vinyl, acetate copolymer, having a durometer which is substantially lower, e.g., 25, than the durometer of the midsole itself, and a density of seven pounds per cubic foot.

In order to lessen the tendency of a runner to pronate excessively, the shoe 20 includes rear foot or heel stablization means 42 (FIG. 3). The stabilization means 42, as will be described in detail later, is located and confined within the heel portion 44 (FIG. 3) of the sole assembly 24 adjacent the inner or medial side 26 thereof. The stabilization means 42 of the instant invention comprises a mass of resilient material having a durometer which is higher than the durometer of the midsole 36 to provide increased resistance to compression at the medial side of the heel portion.

In the embodiment shown in FIGS. 2 and 3, the stabilization means 42 comprises a plurality of cylindrical plugs 46. Each plug extends within a respective vertical bore 48 in the midsole. The bores 48 are disposed within a line extending generally parallel to the peripheral edge of the medial side of the heel portion of the midsole. In accordance with the preferred embodiment of the invention, the plugs are formed of hard rubber, having a durometer of 65.

In the embodiment shown in FIGS. 2 and 3, the plugs are fully confined within the midsole, with the outersole being secured to the bottom of the midsole and covering the bottom end of each of the plugs. The upper portion 22 of the shoe is secured to the top surface of the midsole, so that the plugs are interposed between the upper and outer sole.

Figure 5:
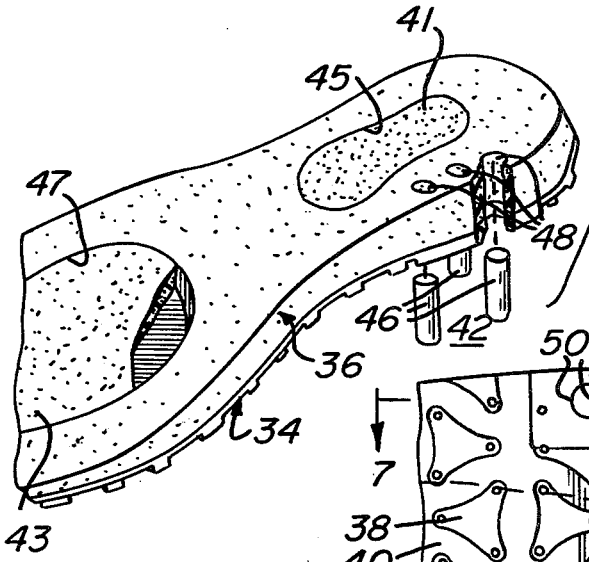
FIG. 5 is a perspective view, similar to that of FIG. 3 but showing an alternative embodiment of the sole of the instant invention.
Figure 6:
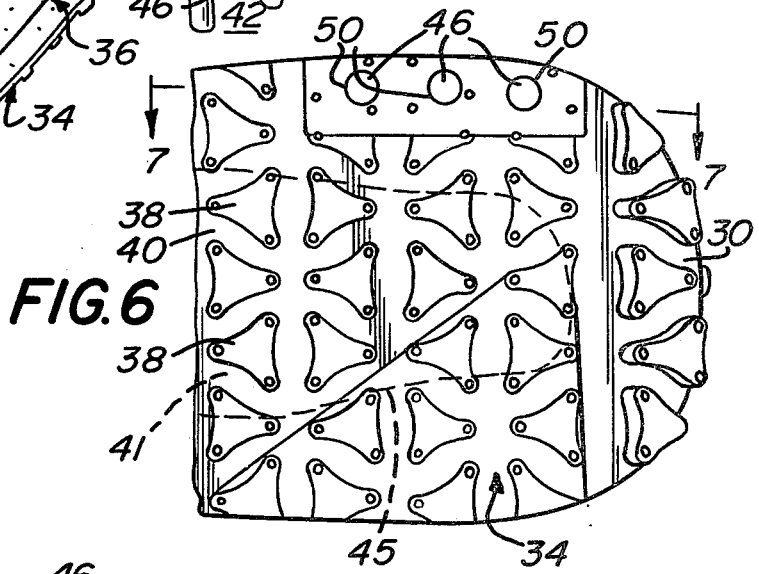
FIG. 6 is an enlarged plan view, similar to that of FIG. 2 and showing the heel portion of the outsole sole shown in FIG. 5.
Figure 7:
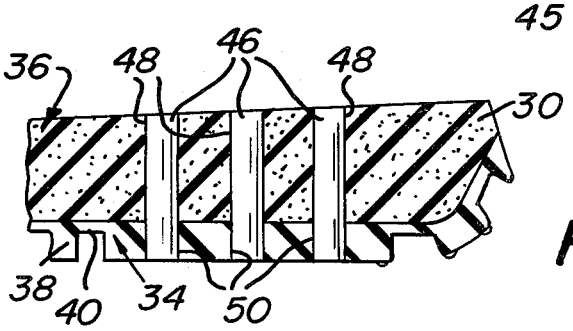
FIG. 7 is an enlarged sectional view taken along line 7—7 of FIG. 6.

In FIGS. 5 and 6 there is shown an alternative embodiment of the instant invention. In the embodiment shown in FIG. 5, the stabilization means 42 is arranged to be inserted within the midsole of the shoe by the purchaser to tailor the degree of heel stabilization to his or her particular needs. To that end, the outersole 34 includes plural access apertures 50 extending therethrough. Each aperture 50 is aligned with and communicates with a respective bore 48 in the midsole. The plugs 46 can thus be inserted by the wearer through the access apertures 50 and into the aligned bores in the midsole. Various different durometer plugs 46 are provided with the shoes so that by the appropriate selection of particular durometer plugs 46, the wearer can, in effect, customize his or her running shoes to the degree of heel stabilization desired. For example, runners who have a greater tendency to overpronate can use higher durometer plugs 46, e.g., 50 durometer, whereas runners who exhibit a lesser tendency to overpronate can use lower durometer plugs, e.g., 40 durometer.

In the embodiment shown in FIG. 5, the plugs 46 may be held in place by their frictional engagement with the walls of the bores 48 or, if desired, can be secured in place, via adhesive means (not shown).

In FIGS. 8 and 9 there is shown yet another alternative embodiment of the instant invention. In the embodiment shown in FIG. 8, the plugs 46 forming the stabilization means 42 are, ganged together to expedite their insertion into bores in the midsole. To that end, as can be seen, the stabilization means comprises three plugs, 46, which are secured together via a plate-like member 52. The plugs 46 extend perpendicular to the inner surface 54 of the plate 52 and are spaced from one another by the distance between the bores 48 in the midsole 36. The thickness of the plate-like member 52 is such that when the plugs are inserted fully within the bores 48 in the midsole, the bottom surface 56 of the plate is flush with the bottom surface 58 of the cleats 40.

The plate-like member is secured in place by locking means (not shown) or by applying an adhesive (not shown) between the inner surface 54 of the plate-like member and the outer surface 60 of the outersole contiguous with the access openings.

In FIG. 12 there is shown still another alternative embodiment of a sole constructed in accordance with the instant invention. In the embodiment shown in FIG. 12, the midsole 36 includes a notched-out portion 62 in the periphery thereof along the medial side of the heel portion. The stabilization means of the embodiment of FIG. 12 comprises a mating mass 64 of resilient material secured within the notch 62. The material 62 is of higher durometer material than the material of the remainder of the midsole 36. In the embodiment shown in FIG. 12, the midsole is constructed of a material like that of the midsoles shown in FIGS. 3, 5 and 8, while the mass 64 forming the stabilization means is constructed of a material like that of the plugs shown in FIGS. 2, 5 and 8.

Figure 14:
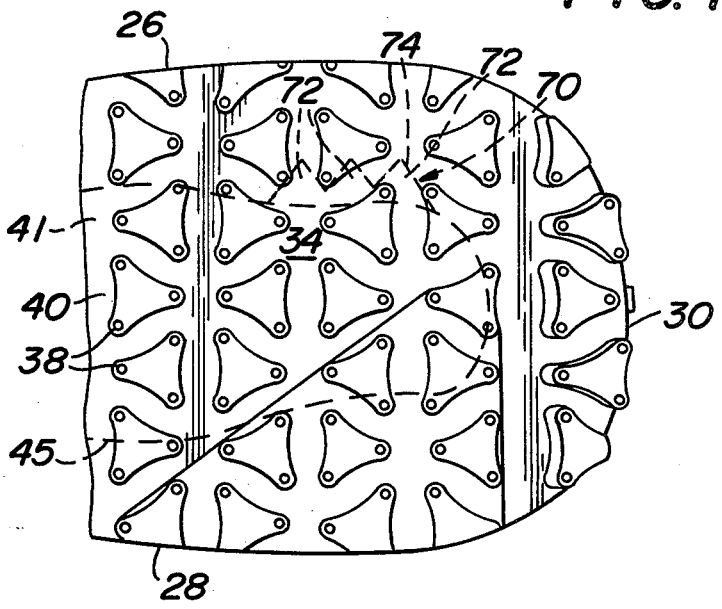
FIG. 14 is a plan view, similar to that of FIG. 2 but showing yet another alternative embodiment of the sole of the instant invention.
Figure 15:
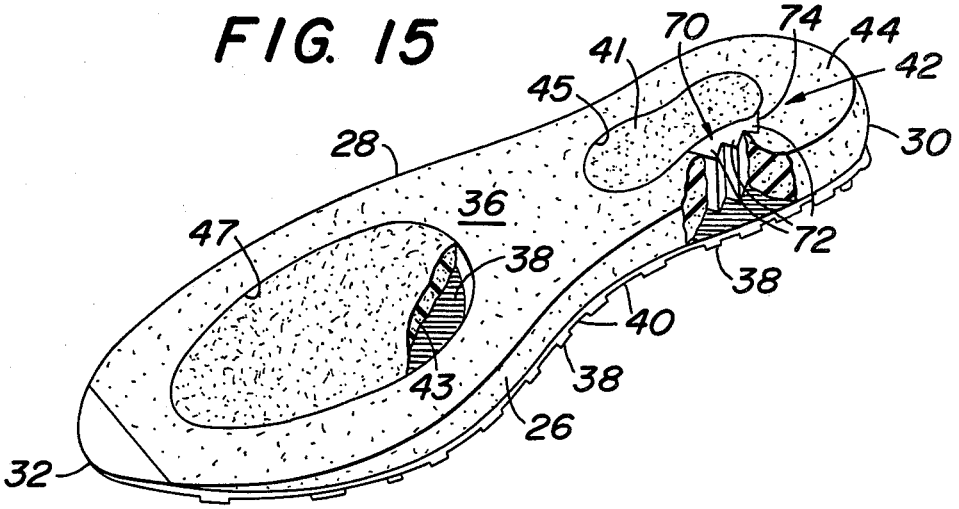
FIG. 15 is an enlarged perspective view of the sole embodiment shown in FIG. 14.

In FIGS. 14 and 15 there is shown yet another embodiment of the instant invention. In that embodiment the stabilization means 42 comprises an integral body or plug 70 located within a sole component like that shown in FIG. 3. The plug 70 is in the form of three generally triangular prism-shaped portions 72. The portions 72 are disposed in a side-by-side parallel array so that body 70 appears saw-toothed when viewed in plan. The body or plug 70 is disposed within a mating saw-toothed recess or notch 74 located in the midsole contiguous with the recess 45 on the medial side of the sole. Like the stabilizing means 42 described heretofore with reference to the other embodiments of this invention, plug 70 is also formed of a resilient material having a higher durometer, e.g., 40 or more, than the remainder of the midsole 36. The midsole 36 of the embodiment of FIG. 14 is constructed of material(s) like that forming the midsole of the previously described embodiments.

It must be pointed out at this juncture that although the plugs of the embodiment shown in FIGS. 2, 5 and 8 are shown as being circular, and the plug of the embodiment shown in FIG. 15 is shown as being parallel connected triangular prisms, plugs in accordance with this invention can, of course, be of any shape and can extend partially or fully through the entire thickness of the midsole. Moreover, they need not extend vertically into the midsole but may be at some other angle with respect to vertical. Furthermore, the specific durometers given heretofore for the midsole material and heel stabilization means are merely exemplary and that other durometers can be used for various applications so long as portions of the sole contiguous with the medial side of the heel portion are of a higher durometer material than the remaining portion of the heel. In so doing, increased resistance to compression is provided at the medial side of the heel, thereby decreasing the tendency of the wearer to overpronate when running in the shoe.

Without further elaboration, the foregoing will so fully illustrate our invention that others may, by applying current or future knowledge, readily adapt the same for use under various conditions of service.

What is claimed as the invention is:

1. A sole component for an athletic shoe comprising a forefoot portion, an arch portion and a heel portion, said heel portion being formed of a first resilient material, and rear foot stabilization means, said stabilization means comprising a mass of a second resilient material located and confined adjacent the medial side of said heel portion, said first resilient material having a first durometer sufficiently low to provide good cushioning and impact absorption, said second resilient material having a second durometer higher than said first durometer to provide resistance to compression at the medial side of said heel portion, thereby lessening the tendency of the shoe to overpronation.

2. The sole component of claim 1 wherein said first durometer is approximately 35 and said second durometer is at least 40.

3. The sole component of claim 1 wherein said sole component forms the midsole of said shoe and wherein said shoe also comprises an outsole.

4. The sole component of claim 3 wherein said mass comprises at least one plug.

5. The sole component of claim 4 wherein said plug is located within a bore in said midsole.

6. The sole component of claim 5 wherein said plug extends through said outsole.

7. The sole component of claim 6 wherein said first durometer is approximately 35 and wherein said second durometer is at least 40.

8. In combination, a sole component for an athletic shoe and rear foot stabilization means therefor, said sole component comprising a forefoot portion, an arch portion and a heel portion, said heel portion being formed of a first resilient material having a first durometer, said sole component comprising at least one opening located and confined adjacent the medial side of said heel portion for receipt of said stabilizaton means therein, said stabilization means comprising a mass of a second resilient material having a second durometer, said first durometer being sufficiently low to provide good cushioning and impact absorption, said second durometer being higher than said first durometer so that the medial side of said heel portion is resistant to compression when said mass is located within said opening.

9. The combination of claim 8 wherein said first durometer is approximately 35 and said second durometer is at least 40.

10. The combination of claim 8 wherein said sole component comprises a midsole and wherein said shoe also comprises an outsole, said outsole includes an opening communicating with the opening in said midsole to enable said mass to be inserted therein.

11. The combination of claim 10 wherein said mass comprises plural plugs and wherein said opening comprises plural bores, each of said bores adapted to receive a respective one of said plugs.

12. The combination of claim 11 wherein said plugs are ganged together.

13. The combination of claim 12 comprising plate-like means for ganging said plugs together, said plate-like means being arranged for securement to said outsole.

14. The combination of claim 13 wherein said outsole includes ground-engaging elements in said heel portion, said plate-like means being located flush with said elements when said plate-like means is secured in place.

15. The combination of claim 14 wherein said first durometer is approximately 35 and said second durometer is at least 40.

16. The combination of claim 8 wherein said sole component includes a mass of a third resilient material having a third durometer and located within said heel portion between the medial and lateral side thereof, said third durometer being lower than said first durometer.

17. The combination of claim 16 wherein said mass is located between said third resilient means and the medial side of said sole component.

18. The combination of claim 17 wherein said third resilient means is located within a recess in said sole component and wherein said mass is located within a notch contiguous with said recess.

19. The combination of claim 18 wherein said mass comprises plural triangular prism-shaped portions.

20. The combination of claim 19 wherein said first durometer is approximately 35, said second durometer is at least 40 and said third durometer is approximately 25.

* * * * *